US007128404B2

(12) United States Patent
Kodama

(10) Patent No.: US 7,128,404 B2
(45) Date of Patent: Oct. 31, 2006

(54) DROPLET DISCHARGE HEAD AND INKJET RECORDING APPARATUS

(75) Inventor: Kenichi Kodama, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 218 days.

(21) Appl. No.: 10/947,239

(22) Filed: Sep. 23, 2004

(65) Prior Publication Data

US 2005/0093931 A1 May 5, 2005

(30) Foreign Application Priority Data

Sep. 24, 2003 (JP) ..... 2003-332466

(51) Int. Cl.
*B41J 2/045* (2006.01)

(52) U.S. Cl. ..... 347/68; 347/89; 347/92

(58) Field of Classification Search ..... 347/17, 347/20, 68, 70, 89, 92
See application file for complete search history.

(56) References Cited

U.S. PATENT DOCUMENTS

| | | | | |
|---|---|---|---|---|
| 4,716,423 | A | 12/1987 | Chan et al. | 347/65 |
| 5,155,498 | A * | 10/1992 | Roy et al. | 347/68 |
| 5,481,284 | A | 1/1996 | Kitahara et al. | 347/42 |
| 5,818,485 | A | 10/1998 | Rezanka | 347/89 |
| 5,956,062 | A | 9/1999 | Omata et al. | 347/89 |
| 6,685,299 | B1 | 2/2004 | Hirota | 347/20 |
| 6,808,254 | B1 * | 10/2004 | Sakaida et al. | 347/68 |
| 2002/0018095 | A1 | 2/2002 | Nakamura et al. | 347/40 |
| 2003/0150931 | A1 | 8/2003 | Drury et al. | 239/102.1 |

FOREIGN PATENT DOCUMENTS

| | | | |
|---|---|---|---|
| JP | 55-079174 | A | 6/1980 |
| JP | 58-187369 | A | 11/1983 |
| JP | 02-143862 | A | 6/1990 |
| JP | 6-24000 | A | 2/1994 |
| JP | 6-183029 | A | 7/1994 |
| JP | 8-244250 | A | 9/1996 |
| JP | 10-114081 | A | 5/1998 |
| JP | 2001-334661 | A | 12/2001 |
| JP | 2002-254643 | A | 9/2002 |
| JP | 2002-355961 | A | 12/2002 |

* cited by examiner

*Primary Examiner*—Juanita D. Stephens
(74) *Attorney, Agent, or Firm*—Birch, Stewart, Kolasch & Birch, LLP

(57) ABSTRACT

The droplet discharge head comprises: a nozzle which discharges droplets of a liquid; a pressure chamber which is in communication with the nozzle and is filled with the liquid to be discharged from the nozzle; and a pressure generation device which generates pressure variation in the liquid inside the pressure chamber and causes the droplets to be discharged from the nozzle, wherein: the pressure chamber has a substantially triangular planar shape; the pressure chamber is provided with a first conduit which conducts the liquid from the pressure chamber to the nozzle, a second conduit which causes the liquid to flow into the pressure chamber, a third conduit which drains the liquid in the pressure chamber to exterior of the pressure chamber, and a switching device which opens and closes a flow channel in at least one of the second and third conduits; and the first, second and third conduits are connected to the pressure chamber at positions in vicinity of different vertices of the substantially triangular shape, respectively.

12 Claims, 15 Drawing Sheets

DROPLET DISCHARGE HEAD AND INKJET RECORDING APPARATUS

This Nonprovisional application claims priority under 35 U.S.C. § 119(a) on Patent Application No(s). 2003-332466 filed in Japan on Sep. 24, 2003, the entire contents of which are hereby incorporated by reference.

BACKGROUND OF THE INVENTION

1. Field of the Invention

The present invention relates to a droplet discharge head and inkjet recording apparatus, and more specifically to the structure for a droplet discharge head effective for removing bubbles within a pressure chamber in communication with a nozzle (droplet discharge port), and to an inkjet recording apparatus that uses the head.

2. Description of the Related Art

Inkjet recording apparatuses deposit ink droplets on a recording medium by relatively moving recording paper or another recording medium with respect to a recording head provided with ink discharge nozzles while discharging ink from the recording head in accordance with a print signal, and an image is formed on the printing medium by the ink dots.

Inkjet heads (recording heads) are configured to feed ink to a pressure chamber in communication with a nozzle, to impart pressure variation to the liquid inside the pressure chamber, and to discharge droplets from the nozzle, so when bubbles are present inside the pressure chamber, the required pressure for discharge is not transmitted to the ink and a discharge defect is created. To prevent such a discharge defect, an action (suctioning action) is carried out to suction away the ink mixed with bubbles inside the pressure chamber and to eliminate the ink together with the bubbles. However, this action has a drawback in that ink consumption for carrying out the suctioning action is increased.

To address this problem, the inkjet head disclosed in Japanese Patent Application Publication No. 6-24000 is configured such that two ink supply ports with different flow resistances are provided to an ink chamber in communication with a nozzle. These two ink supply ports are each connected to a separate reserve tank, and bubbles inside the ink chamber can be drawn into one of the reserve tanks by a pump that controls the switching of ink circulation modes (ink circulation direction).

Also, a structure is disclosed in Japanese Patent Application Publication No. 2002-355961 whereby a circulation flow channel is provided to a common flow channel that is in communication with a plurality of pressure chambers, and bubbles in the common flow channel are recovered together with ink.

Additionally, a structure is disclosed in Japanese Patent Application Publication No. 2002-254643 whereby ink that is to be fed to a nozzle is circulated in a thermal jet-type inkjet head provided with a heating resistor for generating the heat energy required for ink discharge.

However, the configurations proposed in Japanese Patent Application Publication Nos. 6-24000 and 2002-254643 result in the release of pressure to the circulation channel during discharge driving, so a greater amount of discharge actuator power is required. The configuration proposed in Japanese Patent Application Publication No. 2002-355961 allows bubbles inside the common flow channel to be removed, but bubbles inside the pressure chamber cannot be removed.

SUMMARY OF THE INVENTION

The present invention is contrived in view of such circumstances, and an object thereof is to provide a structure for a liquid discharge head in which bubbles can be removed from within the head, more particularly, from within the pressure chamber without carrying out suctioning action from the nozzle, and to an inkjet recording apparatus that uses the head.

In order to attain the above-described object, the present invention is directed to a droplet discharge head, comprising: a nozzle which discharges droplets of a liquid; a pressure chamber which is in communication with the nozzle and is filled with the liquid to be discharged from the nozzle; and a pressure generation device which generates pressure variation in the liquid inside the pressure chamber and causes the droplets to be discharged from the nozzle, wherein: the pressure chamber has a substantially triangular planar shape; the pressure chamber is provided with a first conduit which conducts the liquid from the pressure chamber to the nozzle, a second conduit which causes the liquid to flow into the pressure chamber, a third conduit which drains the liquid in the pressure chamber to exterior of the pressure chamber, and a switching device which opens and closes a flow channel in at least one of the second and third conduits; and the first, second and third conduits are connected to the pressure chamber at positions in vicinity of different vertices of the substantially triangular shape, respectively.

According to the present invention, the planar shape of the pressure chamber is given a substantially triangular shape, and liquid channel ports in communication with each of the first, second, and third conduits, which are the inflow and outflow channels of the pressure chamber, are respectively provided to positions corresponding to the vertices, so that the flow of liquid inside the pressure chamber does not easily pool, and the accumulation of bubbles in the pressure chamber can be prevented. Also, the liquid that was caused to flow from the second conduit into the pressure chamber can be drawn out from the pressure chamber through the third conduit, so that bubbles inside the pressure chamber can be removed. Furthermore, by closing the switching device during discharge operation for discharging droplets from the nozzle, pressure loss can be prevented and discharge force can be assured. A plurality of pressure chambers can be arranged in a two-dimensional, high-density configuration with a structure in which the planar shape of the pressure chamber is a substantially triangular shape, and higher nozzle density can be realized.

Preferably, the switching device is disposed in the third conduit.

Preferably, the droplet discharge head comprises: a plurality of the pressure chambers; a common flow channel which is in communication with the second conduit of each of the pressure chambers; and a circulation flow channel which is in communication with the third conduit of each of the pressure chambers.

Preferably, the droplet discharge head further comprises a switching control device which simultaneously controlling a plurality of the switching devices disposed correspondingly to the plurality of the pressure chambers. In comparison with a configuration in which a plurality of switching devices is individually disposed correspondingly to the plurality of pressure chambers, this aspect allows the number of actuators and other components for opening and closing to be reduced, costs to be cut, manufacturing to be facilitated.

Preferably, the droplet discharge head further comprises: a supply channel side pressure adjustment device which increases pressure in the second conduit, wherein the pressure increased by the supply channel side pressure adjustment device causes the liquid to flow from the second conduit to the pressure chamber and from the pressure chamber to the third conduit.

Alternatively, the droplet discharge head may further comprise: a circulation channel side pressure adjustment device which decreases pressure in the third conduit, wherein the pressure decreased by the circulation channel side pressure adjustment device causes the liquid to flow from the second conduit to the pressure chamber and from the pressure chamber to the third conduit.

Alternatively, the droplet discharge head may further comprise: a supply channel side pressure adjustment device which increases pressure in the second conduit; and a circulation channel side pressure adjustment device which decreases pressure in the third conduit, wherein the pressure increased by the supply channel side pressure adjustment device and the pressure decreased by the circulation channel side pressure adjustment device cause the liquid to flow from the second conduit to the pressure chamber and from the pressure chamber to the third conduit.

Preferably, the pressure is adjusted to satisfy $Pa>Ps>Pc$, where Ps is the pressure in the second conduit, Pc is the pressure in the third conduit, and Pa is an atmospheric pressure.

The present invention is also directed to an inkjet recording apparatus, comprising: an inkjet recording head including the above-described droplet discharge head, wherein an image is recorded onto a recording medium by discharging ink droplets from the nozzles while the recording medium is relatively moved with respect to the inkjet recording head.

In the implementation of the present invention, the shape of the recording head is not particularly limited, and the print head may be a shuttle-type recording head that prints as the recording head reciprocates in the direction that is substantially orthogonal to the feed direction of the recording medium, or a full-line recording head having nozzle rows in which a plurality of nozzles for discharging ink are arrayed across a length that corresponds to the entire width of the printing medium in a direction that is substantially orthogonal to the feed direction of the recording medium.

A "full-line recording head" is normally disposed along the direction orthogonal to the relative feed direction (direction of relative movement) of the printing medium, but also possible is an aspect in which the recording head is disposed along the diagonal direction given a predetermined angle with respect to the direction orthogonal to the feed direction. The array form of the nozzles in the recording head is not limited to a single row array in the form of a line, and a matrix array composed of a plurality of rows is also possible. Also possible is an aspect in which a plurality of short-length recording head units having a row of nozzles that do not have lengths that correspond to the entire width of the printing medium are combined, whereby the image-recording element rows are configured so as to correspond to the entire width of the printing medium, with these units acting as a whole.

The "recording medium" is a medium (an object that may be referred to as a print medium, image formation medium, recording medium, image receiving medium, or the like) that receives the printing of the recording head and includes continuous paper, cut paper, seal paper, OHP sheets, and other resin sheets, as well as film, cloth, and various other media without regard to materials or shapes. In the present specification, the term "printing" expresses the concept of not only the formation of characters, but also the formation of images with a broad meaning that includes characters.

The conveyance device includes an aspect in which the printing medium is conveyed with respect to a stationary (fixed) recording head, an aspect in which the recording head is moved with respect to a stationary printing medium, or an aspect in which both the recording head and the printing medium are moved.

Preferably, the inkjet recording apparatus further comprises a circulation control device which controls the switching device, wherein: when an image is being recorded, the circulation control device controls the switching device to close, and when no image is being recorded, the circulation control device controls the switching device to open so as to flow the liquid inside the pressure chamber into the third conduit.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus

Figure 1:
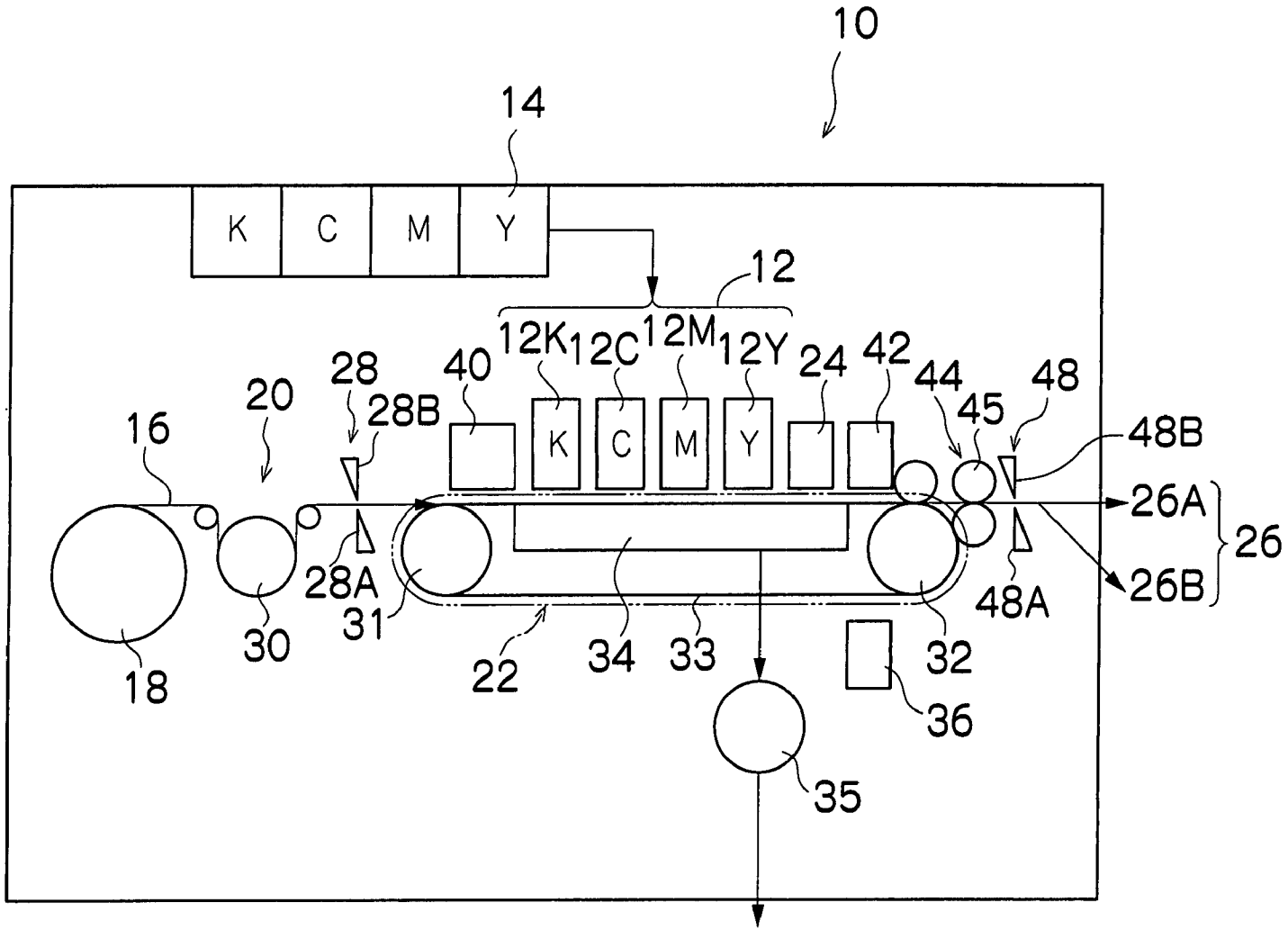
FIG. 1 is an overall block diagram of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that a information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction. The belt 33 is driven in the clockwise direction in FIG. 1 by the motive force of a motor (not shown in FIG. 1, but shown as a motor 150 in FIG. 10) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
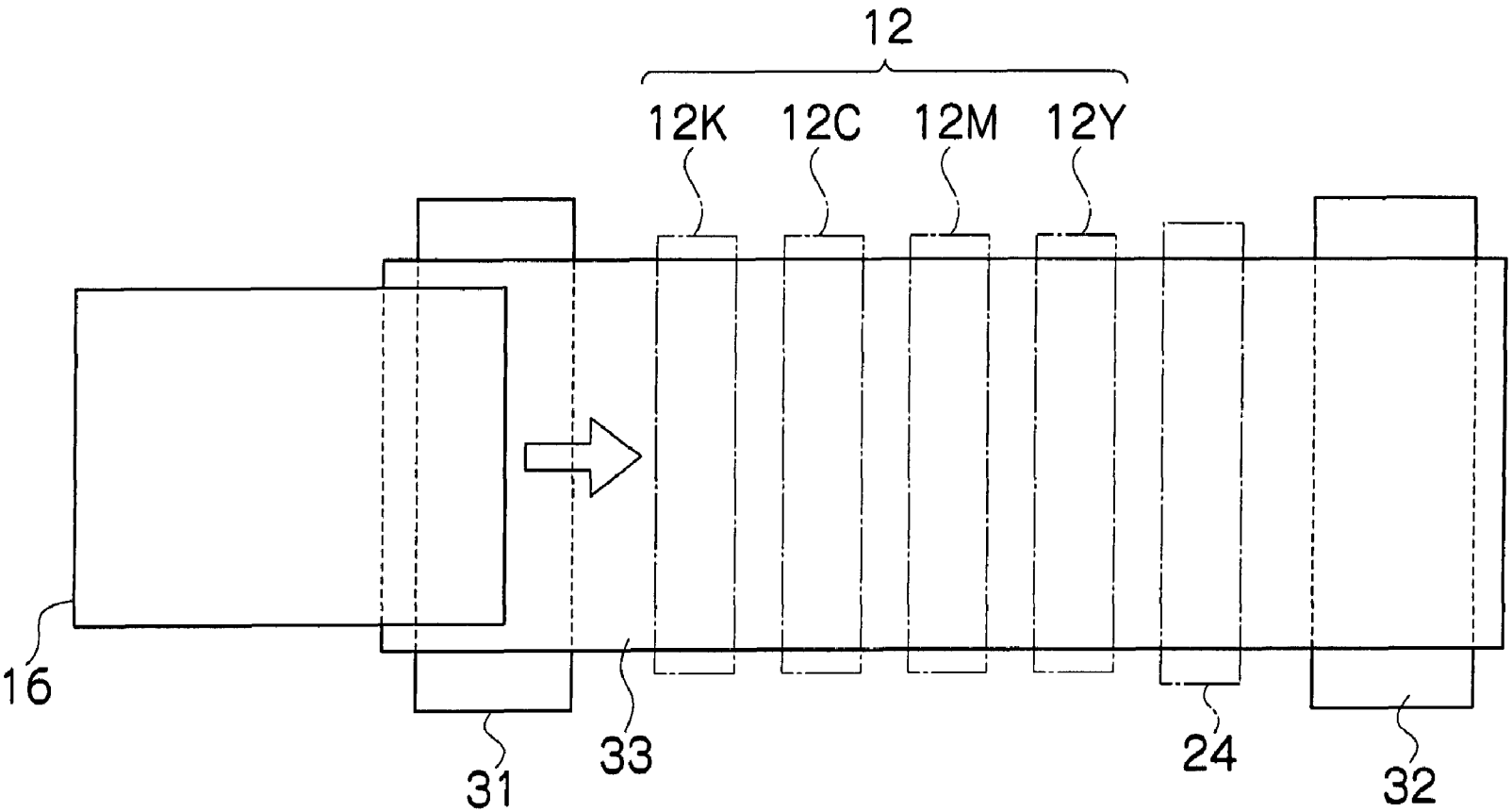
FIG. 2 is a partial plan view of the area around the printing unit of the inkjet recording apparatus.

As shown in FIG. 2, the printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction) represented by the arrow in FIG. 2, which is substantially perpendicular to a width direction of the recording paper 16. A specific structural example is described later with reference to FIGS. 4 to 8. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added. Moreover, a configuration is possible in which a single print head adapted to record an image in the colors of CMY or KCMY is used instead of the plurality of print heads for the respective colors.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor. The print determination unit 24 is configured with a line sensor or an area sensor having rows of photoelectric transducing elements with a width that is greater than the ink-droplet ejection width (image recording width) of the print heads 12K, 12C, 12M, and 12Y.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, a sorter for collecting prints according to print orders is provided to the paper output unit 26A for the target prints.

Figure 3:
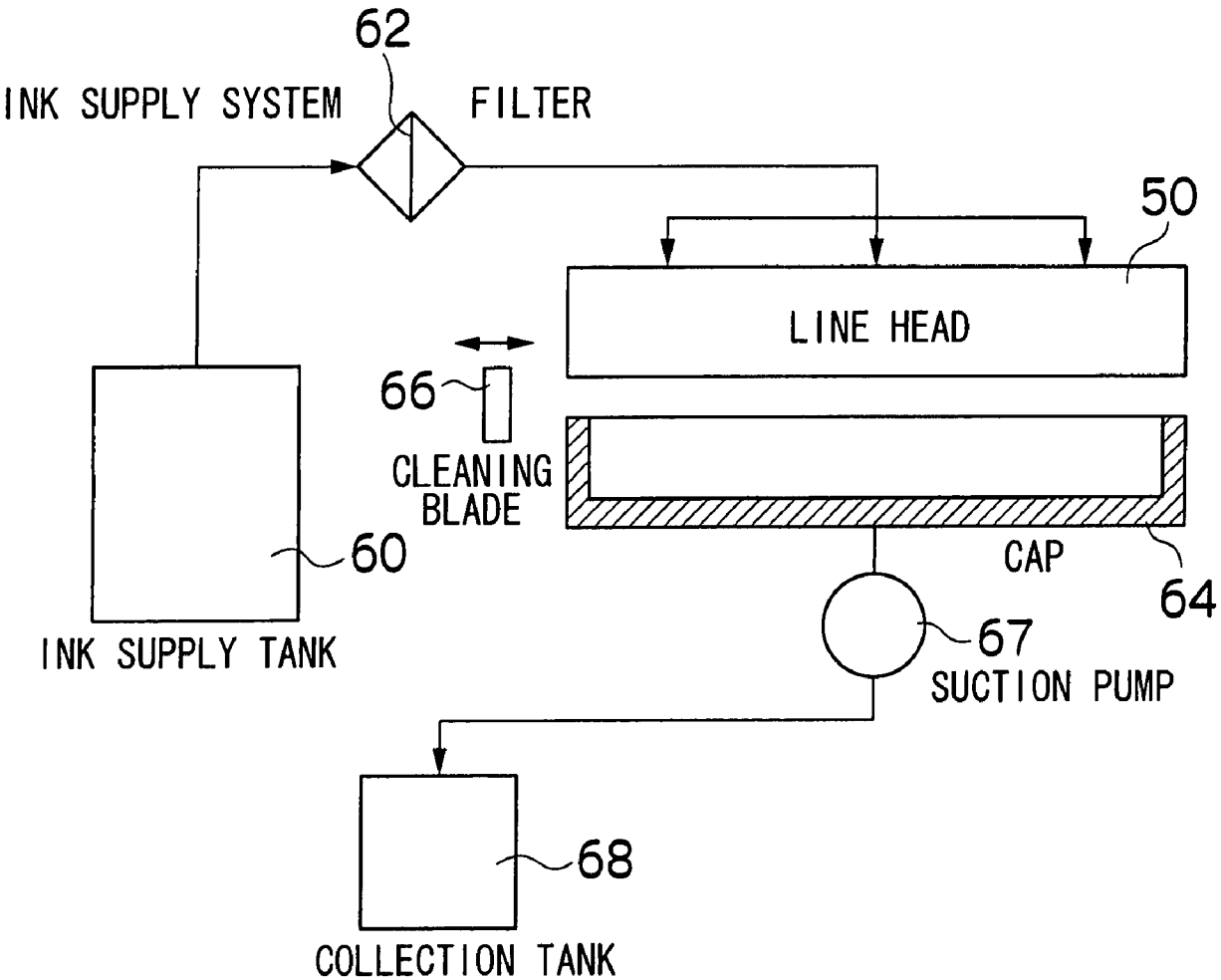
FIG. 3 is a schematic diagram showing the configuration of the ink supply system in the inkjet recording apparatus.

FIG. 3 is a schematic drawing showing the configuration of the ink supply system in the inkjet recording apparatus 10. The print heads 12K, 12C, 12M, and 12Y provided for the ink colors have the same structure, and a reference numeral 50 is hereinafter designated to any of the print heads 12K, 12C, 12M, and 12Y.

An ink supply tank 60 is a base tank that supplies ink and is set in the ink storing/loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 3 is equivalent to the ink storing/loading unit 14 in FIG. 1 described above.

A filter 62 for removing foreign matters and bubbles is disposed between the ink supply tank 60 and the print head 50, as shown in FIG. 3. The filter mesh size in the filter 62 is preferably equivalent to or less than the diameter of the nozzle and commonly about 20 μm.

Although not shown in FIG. 3, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles from drying out or to prevent an increase in the ink viscosity in the vicinity of the nozzles, and a cleaning blade 66 as a device to clean the nozzle face. A maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced up and down in a relative fashion with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the nozzle face is thereby covered with the cap 64.

The cleaning blade 66 is composed of rubber or another elastic member, and can slide on the ink discharge surface (surface of the nozzle plate) of the print head 50 by means of a blade movement mechanism (wiper, not shown). When ink droplets or foreign matter has adhered to the nozzle plate, the surface of the nozzle plate is wiped, and the surface of the nozzle plate is cleaned by sliding the cleaning blade 66 on the nozzle plate.

During printing or standby, when the frequency of use of specific nozzles is reduced and ink viscosity increases in the vicinity of the nozzles, a preliminary discharge is made toward the cap 64 to discharge the degraded ink.

Also, when bubbles have become intermixed in the ink inside the print head 50 (inside the pressure chamber), the cap 64 is placed on the print head 50, ink (ink in which bubbles have become intermixed) inside the pressure chamber 52 is removed by suction with a suction pump 67, and the suction-removed ink is sent to a collection tank 68. This suction action entails the suctioning of degraded ink whose viscosity has increased (hardened) when initially loaded into the head, or when service has started after a long period of being stopped.

When a state in which ink is not discharged from the print head 50 continues for a certain amount of time or longer, the ink solvent in the vicinity of the nozzles evaporates and ink viscosity increases. In such a state, ink can no longer be discharged from the nozzles even if the actuator is operated. Before reaching such a state the actuator 58 is operated (in a viscosity range that allows discharge by the operation of the actuator), and the preliminary discharge is made toward the ink receptor to which the ink whose viscosity has increased in the vicinity of the nozzle is to be discharged. After the nozzle surface is cleaned by a wiper (not shown) of the cleaning blade 66 provided as the cleaning device for the nozzle face, a preliminary discharge is also carried out in order to prevent the foreign matter from becoming mixed inside the nozzles by the wiper sliding operation. The preliminary discharge is also referred to as "dummy discharge", "purge", "liquid discharge", and so on.

When bubbles have become intermixed in the nozzles or the pressure chamber, or when the ink viscosity inside the nozzles has increased over a certain level, ink can no longer be discharged by the preliminary discharge, and a suctioning action is carried out as follows.

More specifically, when bubbles have become intermixed in the ink inside the nozzles and the pressure chamber, ink can no longer be discharged from the nozzles even if the actuator is operated. Also, when the ink viscosity inside the nozzles has increased over a certain level, ink can no longer be discharged from the nozzles even if the actuator is operated. In these cases, a suctioning device to remove the ink inside the pressure chamber by suction with a suction pump, or the like, is placed on the nozzle face, and the ink in which bubbles have become intermixed or the ink whose viscosity has increased is removed by suction.

However, this suction action is performed with respect to all the ink in the pressure chamber, so that the amount of ink consumption is considerable. Therefore, a preferred aspect is one in which a preliminary discharge is performed when the increase in the viscosity of the ink is small.

The cap 64 described with reference to FIG. 3 serves as the suctioning device and also as the ink receptor for the preliminary discharge.

In the embodiments of the present invention, a head structure is provided that allows bubbles inside the pressure chamber to be removed without the suctioning action described above, so that ink consumption due to suctioning action can be reduced. The structure thereof is described below.

Structure of the Print Head

Figure 4:
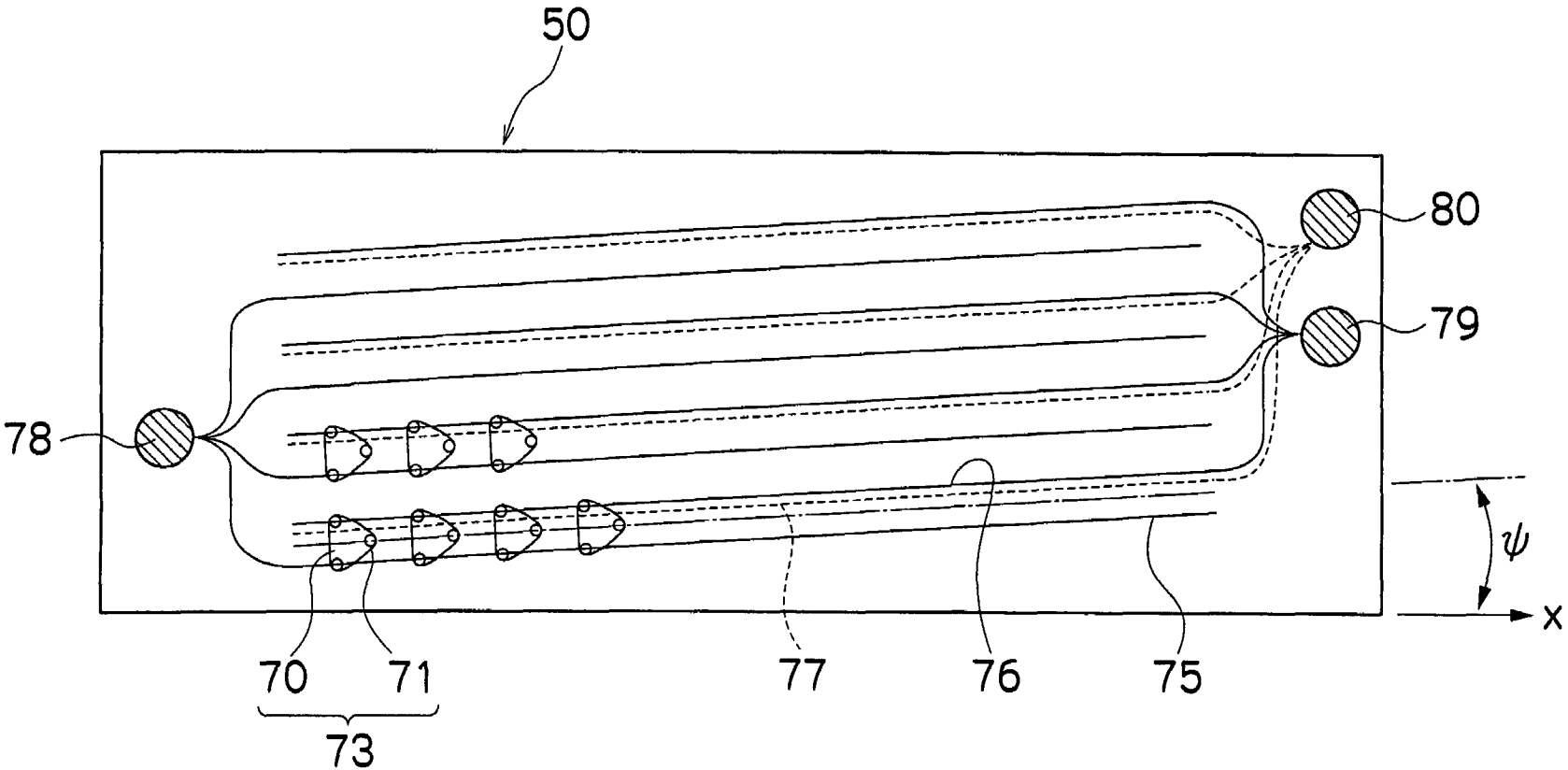
FIG. 4 is plan perspective view showing a structural example of the print head.
Figure 5:
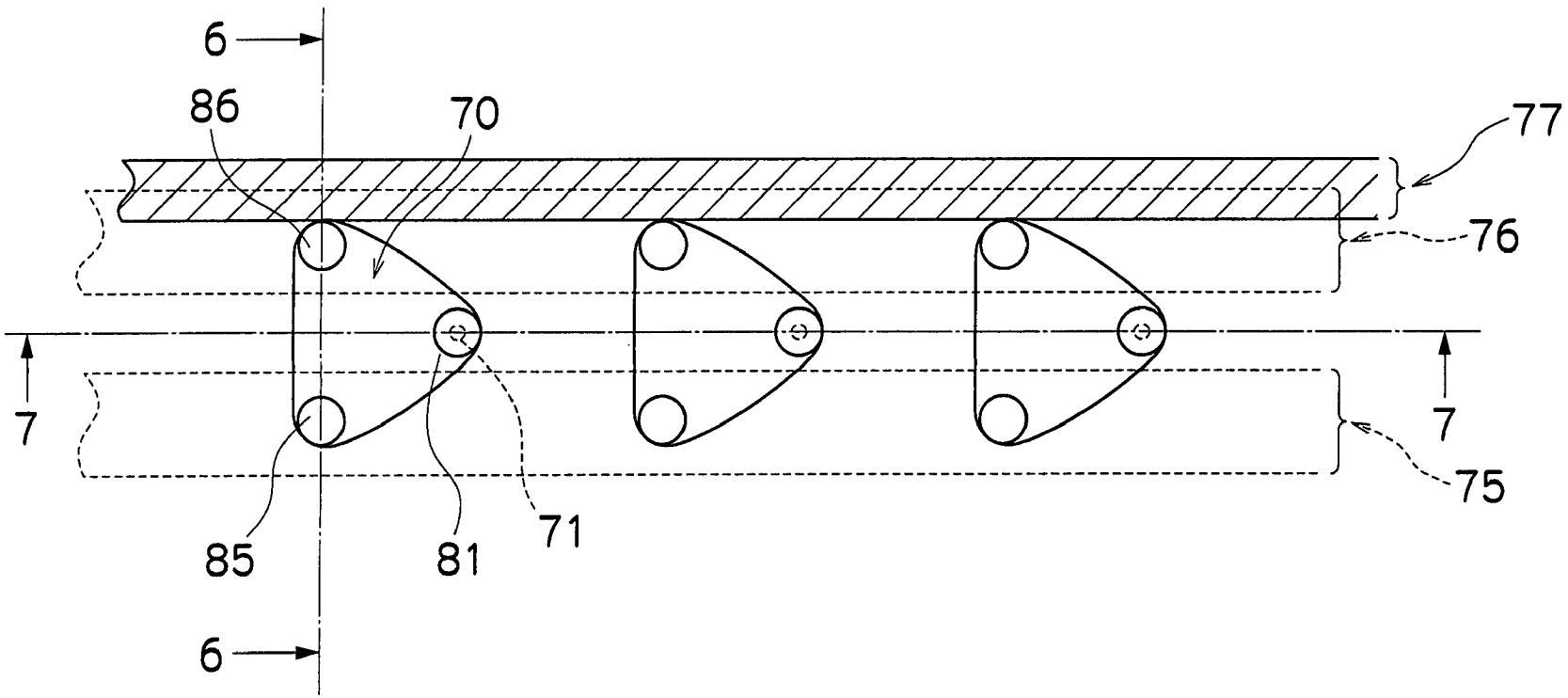
FIG. 5 is a partial enlarged view of FIG. 4.
Figure 6:
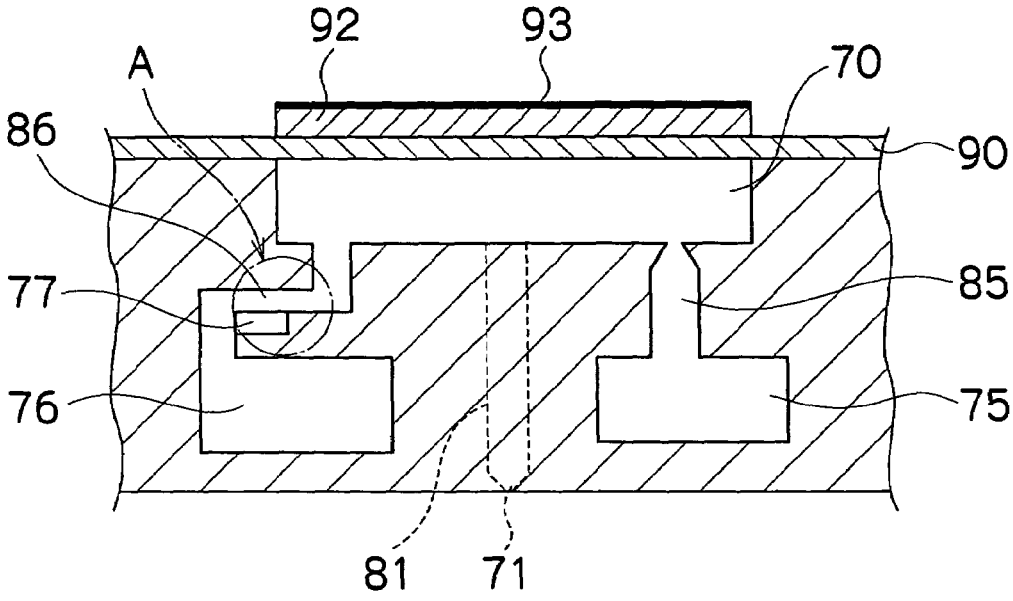
FIG. 6 is a cross-sectional view along line 6—6 in FIG. 5.
Figure 7:
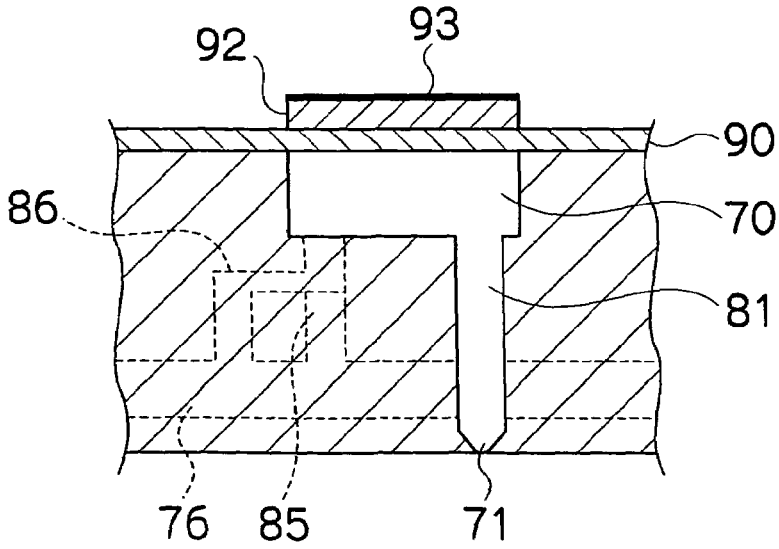
FIG. 7 is a cross-sectional view along line 7—7 in FIG. 5.

FIG. 4 is a schematic plan view showing the internal structure of the print head 50; FIG. 5 is a partial enlarged view of FIG. 4; FIG. 6 is a cross-sectional view along line 6—6 in FIG. 5; and FIG. 7 is a cross-sectional view along line 7—7 in FIG. 5.

Reference numeral 70 in FIG. 4 is a pressure chamber, and 71 is a nozzle. In FIG. 4, the number of pressure chambers 70 is depicted in an abbreviated manner for convenience, but a plurality of pressure chambers 70 with the same configuration is arrayed in the print head 50 in the form of a matrix with predetermined spacing.

The nozzle pitch in the print head 50 should be minimized in order to maximize the density of the dots printed on the surface of the recording paper. The print head 50 in the present embodiment has a structure in which discharge elements (image recording elements) 73, which include the nozzle 71 and the pressure chamber 70 in communication with the nozzle 71, are disposed in the form of a staggered matrix, and the nozzle pitch projected so as to align in the main scanning direction is thereby made small.

The print head 50 shown in FIG. 4 is formed with a structure in which four parallel rows of nozzles aligned in the diagonal row direction with a slightly inclined angle $\psi$ with respect to the lengthwise direction of the head are aligned with predetermined spacing in the column direction that is orthogonal to the row direction. However, in the implementation of the present invention, the structure of the nozzle arrangement is not limited to this example.

Reference numeral 75 in FIG. 4 designates a common flow channel (supply side common flow channel) for supplying ink to each of the pressure chambers 70, reference numeral 76 designates a circulation flow channel (common circulation flow channel) for conducting ink drawn out from the pressure chambers 70 to the circulation system, and reference numeral 77 designates an airflow channel for operating a valve device (membrane 95 in FIG. 8) that opens and closes the separate circulation flow channel (denoted with reference numeral 86 in FIGS. 5 to 8) described hereinafter.

In the print head 50, the common flow channel 75, the circulation flow channel 76, and the airflow channel 77 that are parallel to the nozzle rows are provided correspondingly to the respective nozzle rows, as shown in FIG. 4.

The common flow channels 75 provided for the nozzle rows are brought together in the area (the left hand side in FIG. 4) at the edge of the print head 50 away from the nozzle area (the area in which the nozzles 71 are formed), and are in communication with a supply system connection port 78. The supply system connection port 78 is linked to a supply system conduit (not shown in FIG. 4), and the common flow channels 75 are in communication with the ink supply source (the sub tank or the ink supply tank 60 not shown in FIG. 4) by way of the supply system conduit. The supply system conduit is provided with a supply channel pump 202 (not shown in FIG. 4) for adjusting the pressure of a supply flow channel.

In the same manner, the circulation flow channels 76 corresponding to the nozzle rows are brought together in the area (the right hand side in FIG. 4) at the edge of the print head 50 away from the nozzle area, and are in communication with a circulation system connection port 79. The circulation system connection port 79 is connected to a circulation system conduit and is linked to the supply system conduit, and the circulation flow channels 76 are in communication with the ink supply source (the sub tank or the ink supply tank 60 not shown in FIG. 4) by way of the circulation connection port 79. The circulation system conduit is provided with a circulation channel pump 212 (not shown in FIG. 4) for adjusting the pressure of the circulation flow channel, and the ink drawn out from the pressure chamber to the circulation flow channel is returned to the supply side by way of the circulation system conduit. The ink supply system for supplying the ink to the print head 50 and the ink circulation system for recovering the ink from the print head 50 are later described in detail with reference to FIGS. 9 and 10.

As shown in FIG. 4, the airflow channels 77 corresponding to the nozzle rows are brought together in the area (the right hand side in FIG. 4) at the edge of the print head 50 away from the nozzle area, and are in communication with an air hole 80. The pressure in the airflow channels 77 is increased or decreased by a valve operation pump 100 (not shown in FIG. 4) that is connected to the air hole 80.

As shown in FIG. 5, the planar shape of the pressure chambers 70 is substantially triangular, and a nozzle flow channel 81, a separate supply channel 85, and a separate circulation channel (discharge flow channel) 86 are formed corresponding to vertex positions of the triangle. The nozzle flow channel 81 is in communication with the nozzle 71, and is a conduit for conducting ink from the pressure chamber 70 to the nozzle 71, as shown in FIGS. 6 and 7. The nozzle 71 is the final constricting area from which ink is discharged.

The separate supply channel 85 is in communication with the common flow channel 75, and is a conduit for conducting ink from the common flow channel 75 to the pressure chamber 70. The separate circulation channel 86 is in communication with the circulation flow channel 76, and is a conduit for conducting ink from the pressure chamber 70 to the circulation flow channel 76.

As shown in FIG. 6, an actuator 92 represented by a piezoelement (piezoelectric element) is joined to the vibration plate 90 that constitutes the top surface of the pressure chamber 70. The actuator 92 has a separate electrode 93, and ink is discharged from the nozzle 71 by applying drive voltage to the separate electrode 93 to deform the actuator 92, and imparting pressure variation to the ink inside the pressure chamber 70 by way of the vibration plate 90. When ink is discharged from the nozzle 71, new ink is fed from the common flow channel 75 through the separate supply channel 85 to the pressure chamber 70.

Figure 8:
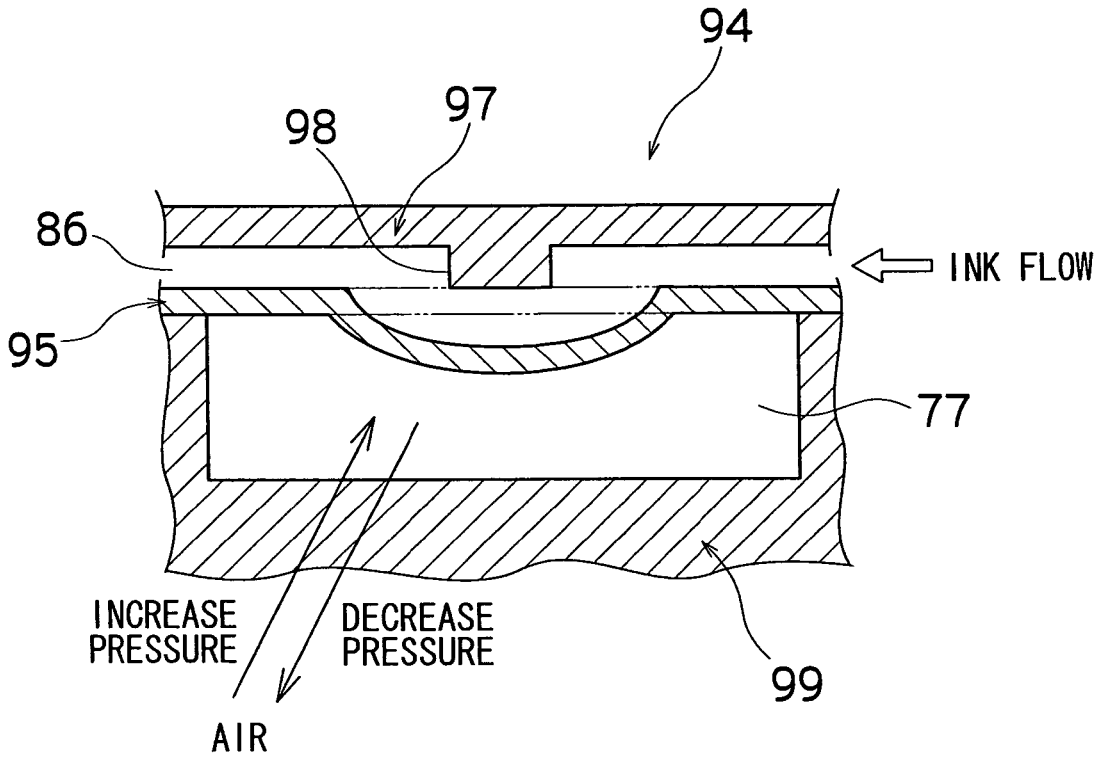
FIG. 8 is a cross-sectional view showing the structure of the valve provided to the area indicated by the circle A in FIG. 6.

An enlarged view of the area indicated by the circle A in FIG. 6 is shown in FIG. 8. A valve 94 for opening and closing the flow channel is disposed in the separate circulation channel 86, as shown in FIG. 8. The valve 94 is configured to deform a membrane (soft member) 95 composed of silicone rubber or the like with air pressure. More specifically, a valve member 98 with a predetermined shape for cutting off the flow channel is provided in a protruding manner to a portion of a first support substrate 97 constituting the separate circulation channel 86, and the membrane 95 is disposed on the flow channel surface facing the valve member 98. The membrane 95 is mounted on the second support substrate 99 for defining the airflow channel 77, and the membrane 95 is moved to open and close the flow channel by increasing or decreasing the pressure of the airflow channel 77.

When the pressure in the airflow channel 77 is decreased, the membrane 95 sags to open the flow channel, as shown by the solid line in FIG. 8. Conversely, when the airflow channel 77 is opened to the atmosphere (pressurized), the membrane 95 moves to the position shown by the alternate long and two short dashes line in FIG. 8 and makes contact with the valve member 98, and the flow channel is closed.

By adopting such a configuration, the device for increasing/decreasing the air pressure inside the airflow channel 77 can be used in common with a plurality of pressure chambers 70, so the valves 94 for all pressure chambers 70 inside the head can be controlled simultaneously (in unison) by increasing or decreasing the pressure with a single pump (the valve operation pump 100).

In accordance with this structure, the number of actuators can be considerably reduced in comparison with an aspect in which actuators or the like are provided for individually driving valves for each pressure chamber 70.

For the valve 94 with the structure exemplified in FIG. 8, it is preferable to increase the pressure on the membrane 95 during discharge operation. Were pressure on the membrane 95 not to be increased during discharge operation, the membrane 95 would move by the driving of the actuator 92 during discharge operation, the valve 94 would open, and the pressure would be released. Therefore, discharge can be made even more stable by increasing the pressure in the airflow channel 77 and controlling the fluctuation of the membrane 95 during a discharge operation such as that described above.

Figure 9:
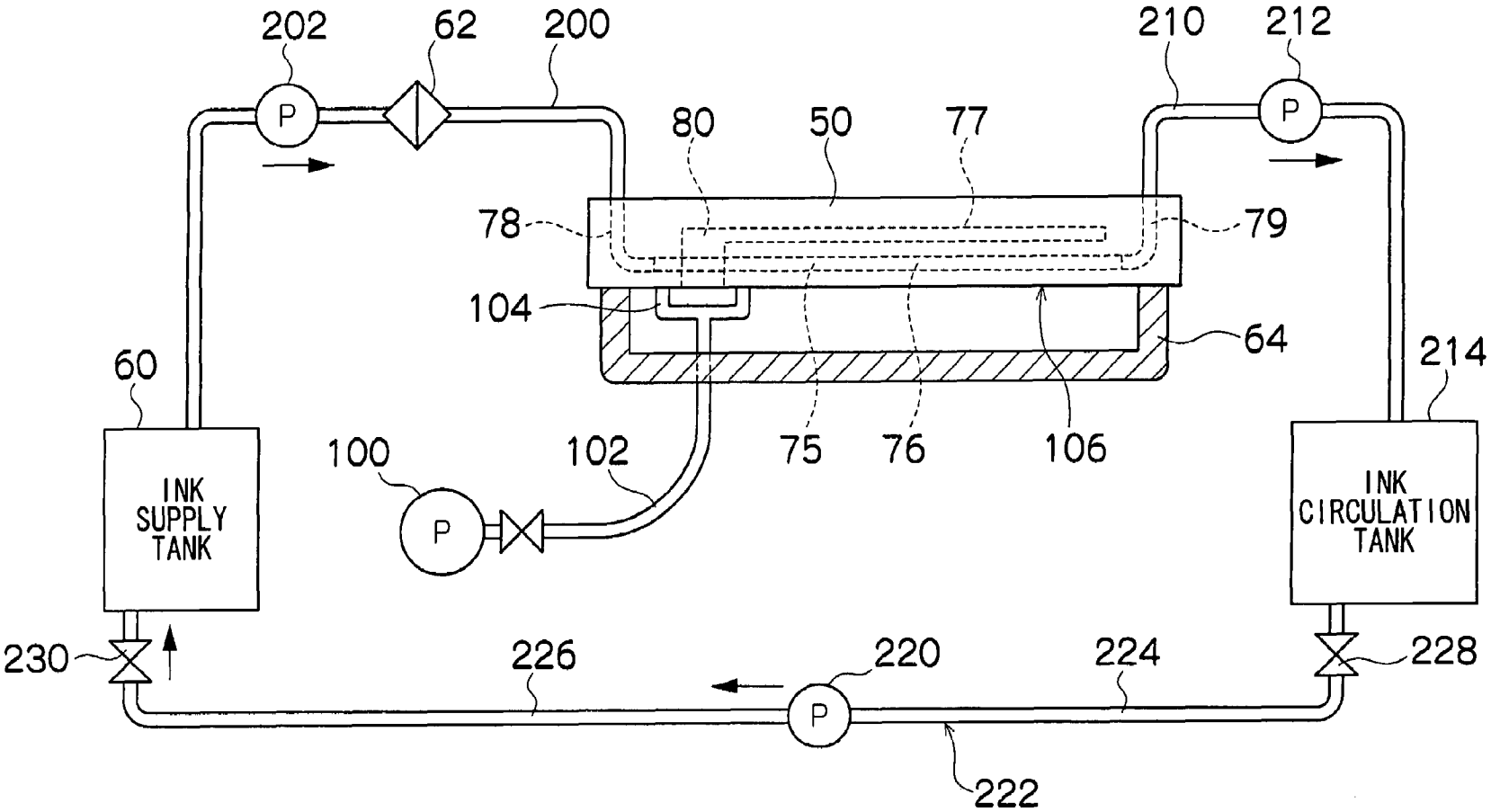
FIG. 9 is a cross-sectional view showing an example of carrying out valve operations in coordination with cap operations.
Figure 10:
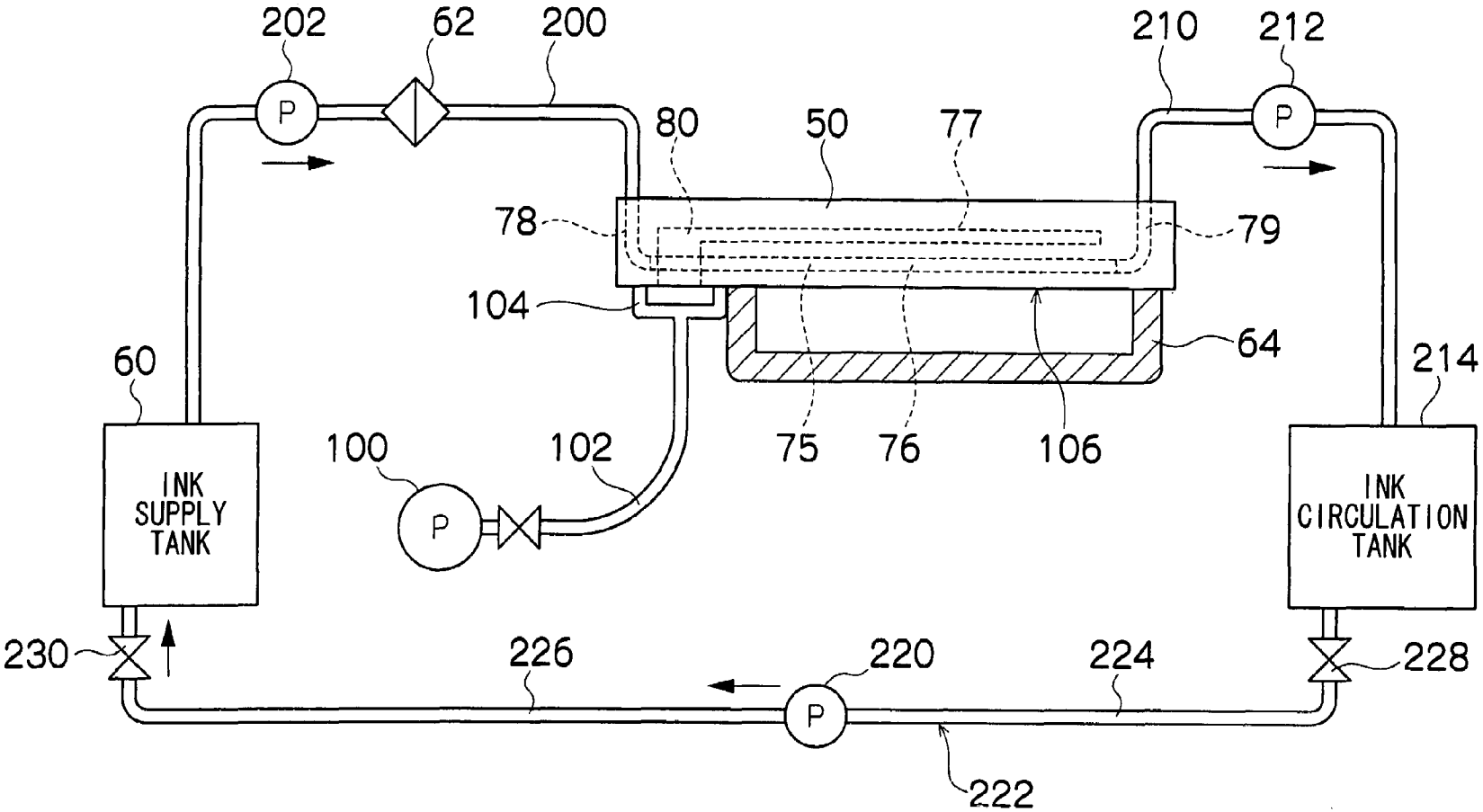
FIG. 10 is a schematic side view showing another example of carrying out valve operations in coordination with cap operations.

Also possible is an aspect in which the operation of the valve 94 is carried out in coordination with the operation of the cap 64. Examples thereof are shown in FIGS. 9 and 10. In the example shown in FIG. 9, the structure is one in which the air hole connection portion 104 at the end of the tube 102 in communication with the valve operation pump 100 is disposed inside the cap 64. In this structure, the airflow channel 77 for deforming the membrane 95 when the cap is not mounted is opened to the atmosphere. When the cap 64 is mounted on the nozzle surface 106 of the print head 50, the air hole connection port 104 is linked to the air hole 80 formed in the nozzle surface 106. The pressure in the airflow channel 77 inside the print head 50 is increased or decreased by driving the valve operation pump 100 in this state, and the membrane 95 can be deformed as described in FIG. 8.

In FIG. 9, reference numeral 200 is the supply system conduit, 202 is a pump (the supply channel pump) functioning as a supply channel side pressure adjusting device, 210 is the circulation system conduit, and 212 is a pump (the circulation channel pump) functioning as a circulation channel side pressure adjusting device.

When the supply channel pump 202 is driven to apply pressure to the print head 50, the ink is fed from the ink supply tank 60 to the print head 50, and the ink is supplied to the common flow channel 75 in the print head 50. On the other hand, when the circulation channel pump 212 is driven to decrease the pressure in the print head 50, the ink inside the print head 50 is sent to the circulation system conduit 210, and further sent to an ink circulation tank 214.

The ink circulation tank 214 contains the ink having been collected in circulation from the print head 50, and is connected to the ink supply tank 60 through an ink feeding channel 222 provided with a pump 220.

As shown in FIG. 9, the ink feeding channel 222 includes the pump 220, an intake side conduit 224, an outlet side conduit 226, and check valves 228 and 230. The ink circulation tank 214 is connected to the intake side conduit 224 through the check valve 228, and the intake side conduit 224 is connected to the intake of the pump 220. The ink supply tank 60 is connected to the outlet side conduit 226 through the check valve 230, and the outlet side conduit 226 is connected to the outlet of the pump 220. The check valves 228 and 230 are controlled to open and close by a system controller 112 (not shown in FIG. 9, but shown in FIG. 11). When the check valves 228 and 230 are opened and the pump 220 is driven, the ink contained in the ink circulation tank 214 is sent to the ink supply tank 60 to be reused.

In the example shown in FIG. 10, the structure is one in which the air hole connection portion 104 at the end of the tube 102 in communication with the valve operation pump 100 is disposed outside the cap 64, and the air hole connection port 104 and the cap 64 are integrally configured via a supporting member (not shown). The same or similar members in FIG. 10 with the members in FIG. 9 are denoted with the same reference numerals, and description thereof is omitted here.

As shown in FIG. 10, when the cap 64 is mounted on the nozzle surface 106 of the print head 50, the air hole connection port 104 is linked to the air hole 80 formed in the nozzle surface 106. The pressure in the airflow channel 77 inside the print head 50 is increased or decreased by driving the valve operation pump 100 in this state, and the membrane 95 can be deformed as described in FIG. 8.

By adopting a configuration in which the operation of the valve 94 is interlinked with the cap operation, the head configuration is simplified because there are no extraneous tubes (tube 102 and the like) from the print head 50 during discharge driving, as shown in FIGS. 9 and 10. Also, the head and the print medium can be brought closer together during printing (during discharge driving).

Although the constructions have been described with reference to FIGS. 9 and 10 including the supply channel pump 202 to increase pressure at the supply side and the circulation channel pump 212 to decrease pressure at the circulation side, one of the supply channel pump 202 and the circulation channel pump 212 is dispensable in the implementation of the present invention.

Description of the Control System

Next, the control system of the inkjet recording apparatus 10 is described.

Figure 11:
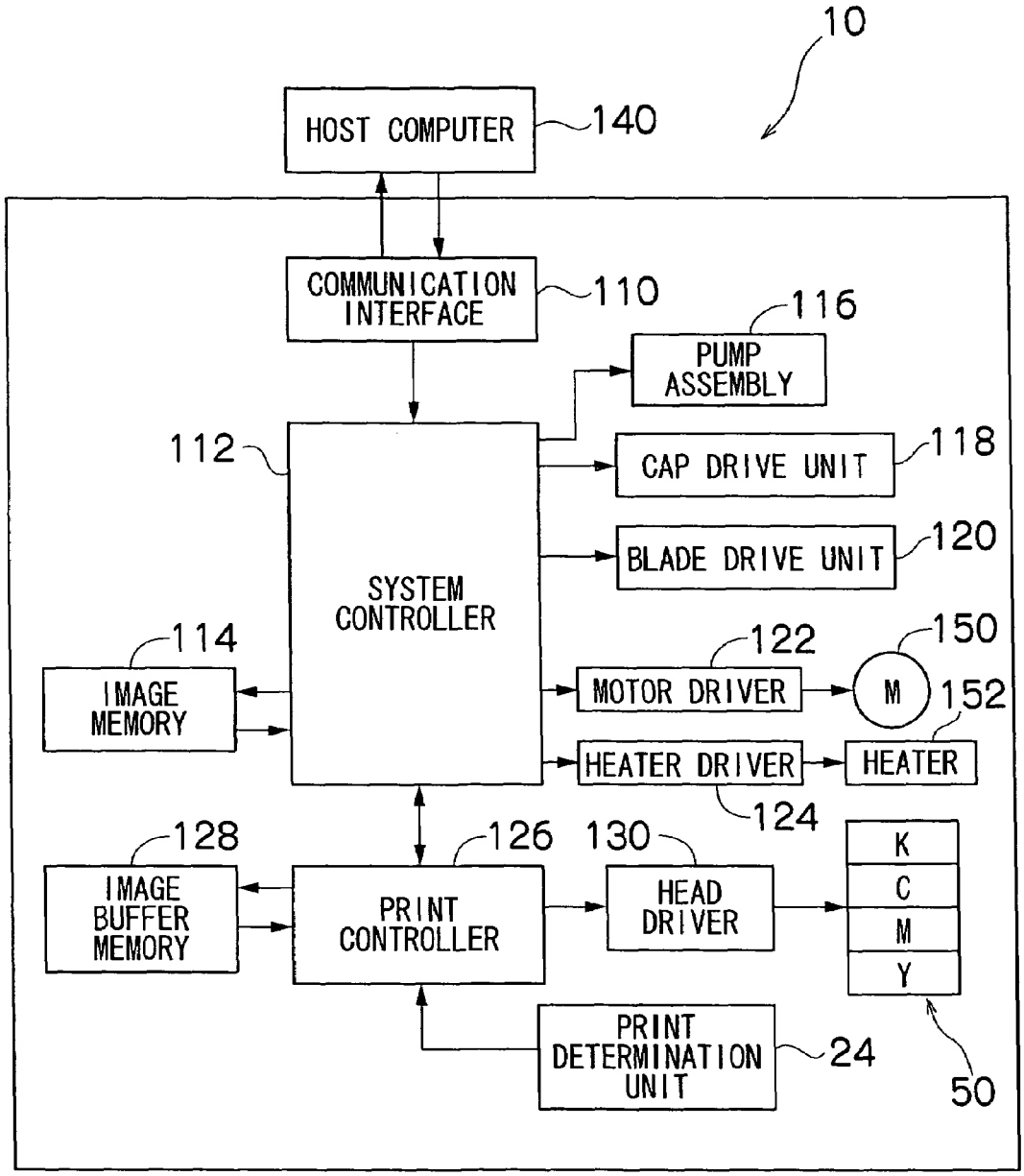
FIG. 11 is a partial block diagram showing the system configuration of the ink-jet recording apparatus.

FIG. 11 is a partial block diagram showing the system configuration of the ink-jet recording apparatus 10. The inkjet recording apparatus 10 has a communication interface 110, a system controller 112, an image memory 114, a pump assembly 116, a cap drive unit 118, a blade drive unit 120, a motor driver 122, a heater driver 124, a print controller 126, an image buffer memory 128, a head driver 130, and other components.

The pump assembly 116 includes the suction pump 67, the valve operation pump 100, the supply channel pump 202, the circulation channel pump 212, and other pumps. The cap drive unit 118 is a drive device for moving the cap 64. The blade drive unit 120 is a drive device for moving the cleaning blade 66.

The communication interface 110 is an interface unit for receiving image data sent from a host computer 140. A serial interface such as USB, IEEE1394, Ethernet, or wireless network, or a parallel interface such as a Centronics interface may be used as the communication interface 110. A buffer memory (not depicted) may be mounted in this portion in order to increase the communication speed.

The image data sent from the host computer 140 is read by the inkjet recording apparatus 10 by way of the communication interface 110, and is temporarily stored in the image memory 114. The image memory 114 is a storage device for temporarily storing images input by way of the communication interface 110, and data is written by way of the system controller 112. The image memory 114 is not limited to memory composed of a semiconductor element, and a hard disk drive or another magnetic medium may be used.

The system controller 112 is a controller for controlling the communication interface 110, the image memory 114, the pump assembly 116, the cap driving unit 118, the blade driving unit 120, the motor driver 122, the heater driver 124, and other components. The system controller 112 has a central processing unit (CPU), peripheral circuits therefor, and the like. The controller controls communication between itself and the host computer 140, controls reading and writing from and to the image memory 114, and performs other functions, and also generates control signals for controlling the pump assembly 116, the cap driving unit 118, the blade driving unit 120, the conveyance system motor 150, the heater 152, and the like.

The motor driver 122 is a driver (drive circuit) for driving the motor 150 in accordance with commands from the system controller 112. The heater driver 124 is a driver for driving the heater 152 of the post-drying unit 42 or the like in accordance with commands from the system controller 112.

The print controller 126 has a signal processing function for performing various tasks, corrections, and other types of processing for generating print control signals from the image data inside the image memory 114 in accordance with commands from the system controller 112, and is a controller for feeding the generated print control signals (dot data) to the head driver 130.

Required signal processing is performed in the print controller 126, and the discharge timing and discharge amount of the ink droplet from the print head 50 are controlled via the head driver 130 according to the image data. A desired dot size and dot placement can be brought about thereby.

The print controller 126 is provided with image buffer memory 128; and image data, parameters, and other data are temporarily stored in the image buffer memory 128 when image data is processed in the print controller 126. The aspect shown in FIG. 10 is one in which an image buffer memory 128 accompanies the print controller 126, but it may also serve as the image memory 114. Also possible is an aspect in which the print controller 126 and the system controller 112 are integrated to form a single processor.

The head driver 130 drives the actuator 92 for the print heads 12K, 12C, 12M, and 12Y of the colors according to the print data received from the print controller 126. A feedback control system whereby the drive conditions for the head are kept constant may be included in the head driver 130.

The print determination unit 24 is a block that contains a line sensor, as described in FIG. 1, reads the image printed on the recording paper 16, detects the print conditions (presence of the discharge, variation in the droplet ejection, and the like) by performing desired signal processing or the like, and provides the detection results thereof to the print controller 126.

The print controller 126 makes various corrections to the print head 50 as required according to the information obtained from the print determination unit 24.

Next, the operation of the inkjet recording apparatus 10 configured as described above is described.

Figure 12:
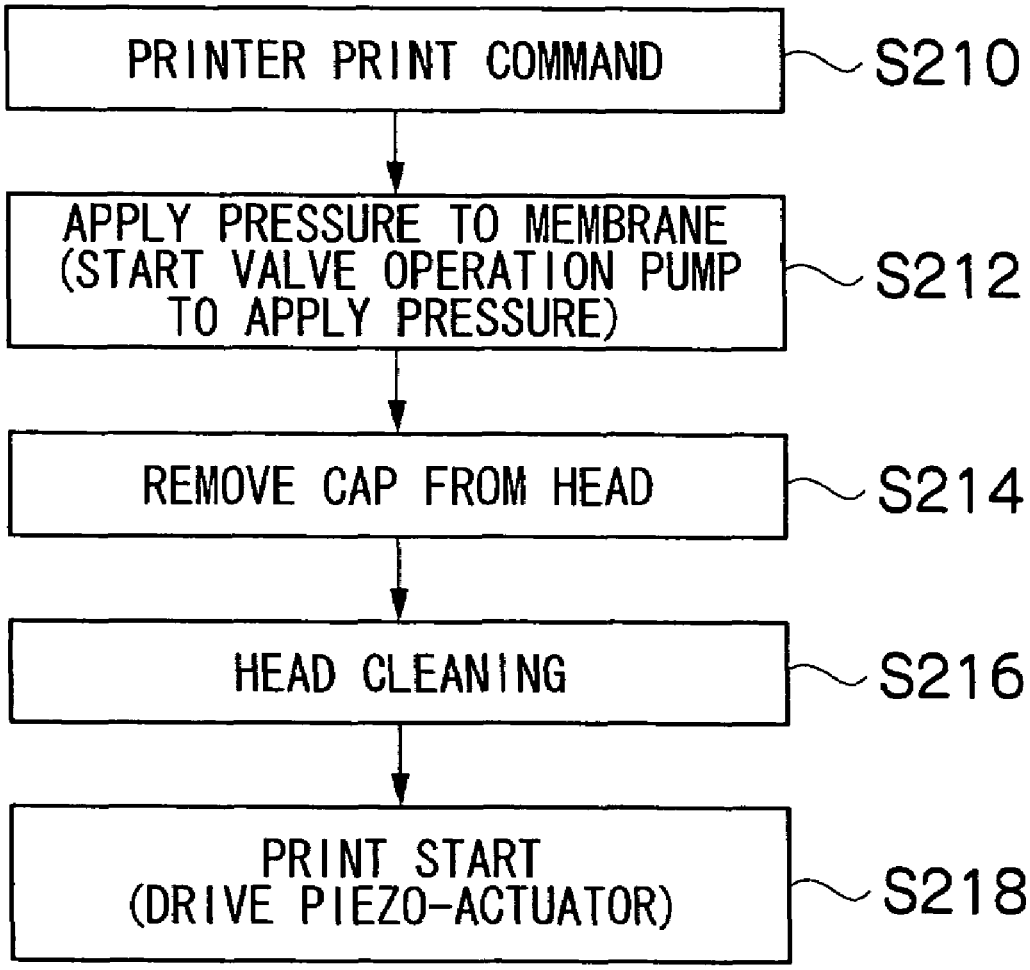
FIG. 12 is a flowchart showing the sequence at the start of printing.

FIG. 12 is a flowchart showing the sequence at the start of printing. As shown in FIG. 12, when a print command is inputted to the inkjet recording apparatus 10 (step S210), the system controller 112 drives the valve operation pump 100 to increase the pressure on the membrane 95 (step S212). Next, the cap 64 is separated from the print head 50 (step S214), and the head is cleaned (step S216).

After the head cleaning is completed, the actuator is driven in a controlled manner to begin printing (step S218). During printing operation, pressure is applied to the membrane 95, and the loss of discharge pressure produced by the actuator 92 can be prevented.

Figure 13:
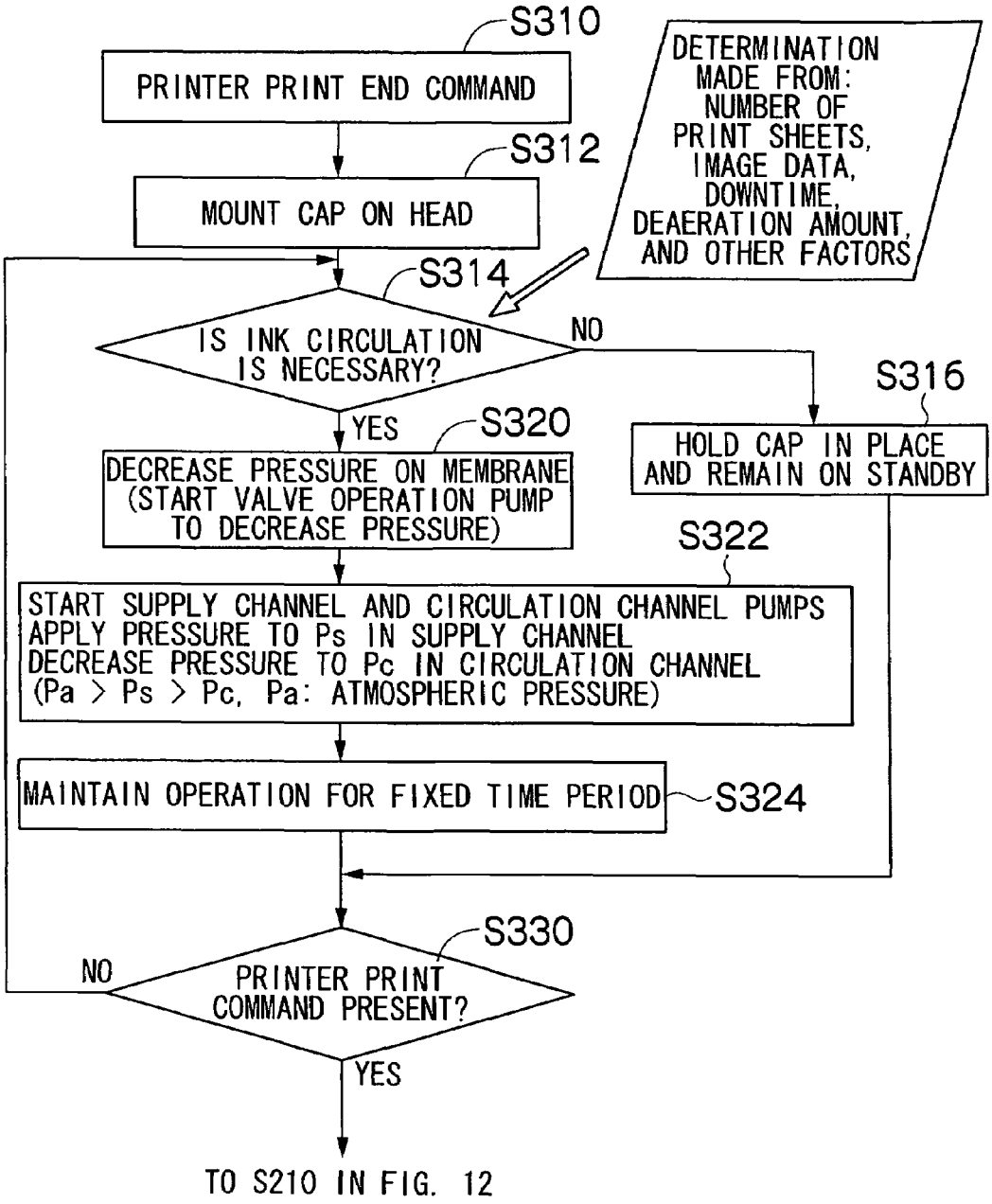
FIG. 13 is a flowchart showing the bubble removal sequence at the completion of printing.

FIG. 13 is a flowchart showing the bubble removal sequence at the completion of printing. As shown in FIG. 13, when a command to end printing is inputted (step S310), the cap 64 is mounted on the print head 50 (step S312). Next, the system controller 112 determines the necessity of circulating the ink inside the head (step S314). This determination routine follows a prescribed determination algorithm, and makes a determination based on the number of sheets to be printed, the operating condition of each nozzle, the downtime, the time elapsed since the previous circulation operation, the deaeration amount, and other factors.

In step S314, the cap is held in its mounted state and kept on standby (step S316) when it has been determined that ink circulation is not required. The presence of a print command is then checked (step S330), and when no print command is present, the process returns to step S314.

When it has been concluded in step S314 that ink circulation is required, the valve operation pump 100 provides is driven to create suction, and the pressure to the membrane 95 is decreased (step S320). Thus, the flow channel of the separate circulation channel 86 opens, the supply channel pump 202 and the circulation channel pump 212 operate, and the liquid inside the pressure chamber 70 is circulated (step S322). In this case, pressures are controlled so as to satisfy the following Formula 1:

$$Pa>Ps>Pc, \quad (1)$$

where Ps is the supply channel side pressure, Pc is the circulation channel side pressure, and Pa is the atmospheric pressure.

In this case, the above Formula 1 is easily satisfied when the supply channel pump 202 is switched off and the circulation channel pump 212 is switched on. This procedure is preferable in that ink can be prevented from leaking from the nozzle.

Ink inside the pressure chamber 70 is drawn out to the circulation flow channel 76 by the pressure gradient, and new ink is filled from the common flow channel 75 into the pressure chamber 70. The bubbles inside the pressure chamber 70 are removed together with ink by the circulation of ink.

The ink that is mixed with bubbles that have been drawn out from the circulation channel is sent to a sub tank and deaerated with a deaeration device. Ink from which bubbles have been removed is once again supplied through the supply channel to the pressure chamber.

The circulation operation of step S322 is continued for a fixed length of time (step S324), and the process then advances to step S330.

Bubbles inside the pressure chamber 70 can be removed by this manner of control without performing suctioning action from the nozzle 71.

In the flowchart in FIG. 13, an example is shown in which circulation operation is carried out in a state in which the cap 64 is mounted on the print head 50, but in accordance with the conditions in the Formula 1, it is also possible to eliminate bubbles without mounting the cap 64.

Figure 14:
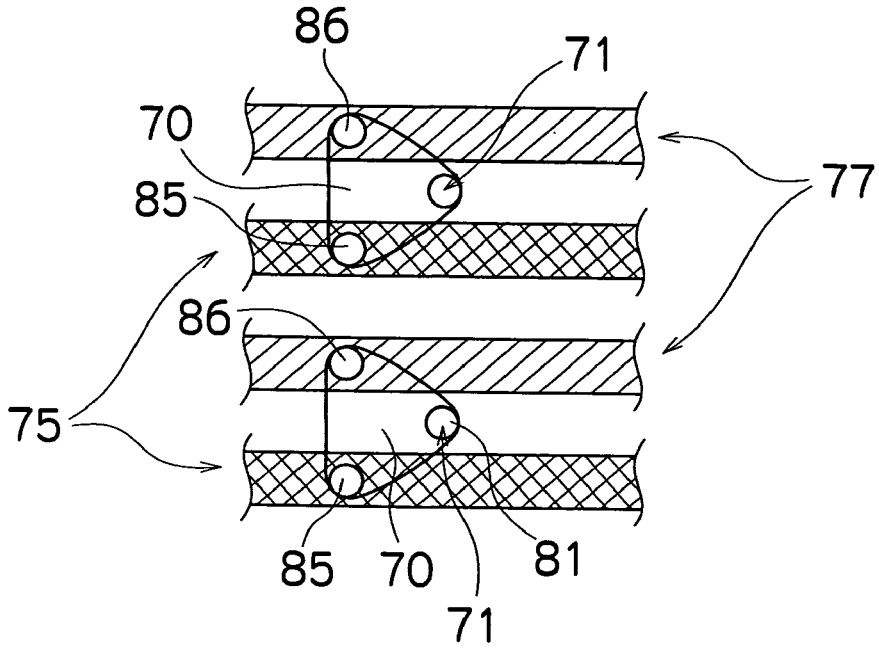
FIG. 14 is a partial enlarged view of FIG. 4 showing a configurative relationship between the pressure chamber and the flow channel.
Figure 15:
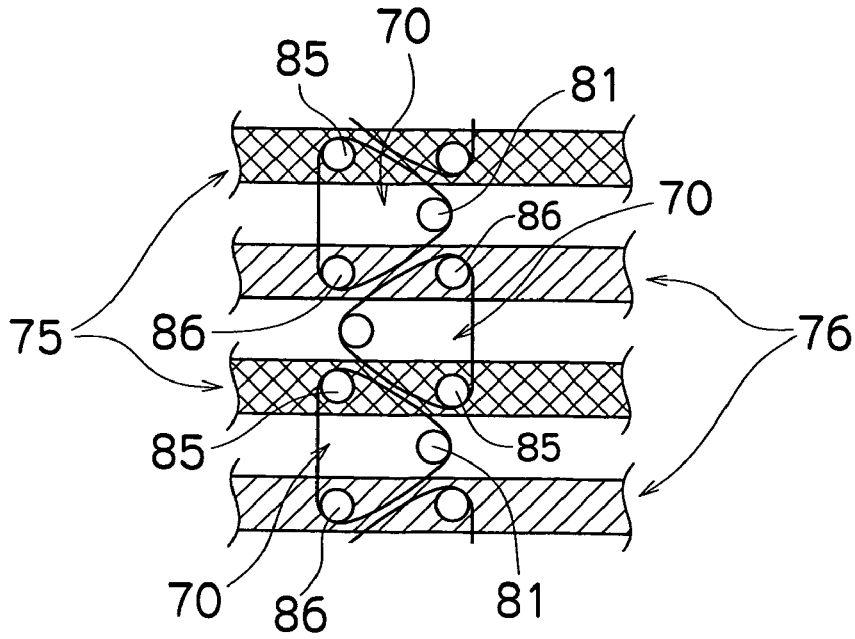
FIG. 15 is a diagram exemplifying another configurative relationship between the pressure chamber and the flow channel.

In the print head 50 described in the above embodiment, the common flow channel 75 and the circulation flow channel 76 are respectively provided to each row of nozzles, as shown in the partial enlarged view in FIG. 14, but also possible in the implementation of the present invention is an aspect in which the same flow channel is shared by the vertically neighboring pressure chambers (pressure chambers of different nozzle rows) 70, as shown in FIG. 15. In accordance with this aspect, it is also possible to arrange pressure chambers 70 at an even greater density.

Also preferable is an aspect in which the actuator 92 for discharging during the above circulation operation is vibrated slightly in a range that does not reach discharge force. The movement of bubbles adhering to the flow channel walls of the pressure chamber 70 can be urged on by these small vibrations.

Furthermore, in the above embodiment, the valve 94 is provided to the separate circulation channel 86 side, but another preferable aspect is one in which another valve is provided in the same manner to the separate supply channel 85, and the valves on the supply channel side and the circulation channel side are closed during discharge or preliminary discharge. This aspect can ensure further improvement in discharge stability and increase the preliminary discharge force.

Specific Examples of the Shape of the Pressure Chamber

Examples of the shape of the pressure chamber 70 are shown in FIGS. 16A to 19.

Figure 16A:
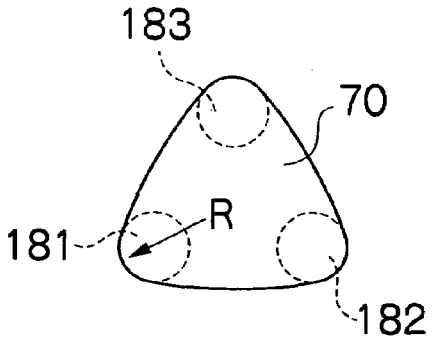
FIGS. 16A and 16B are diagrams showing an example of the shape of the pressure chamber.
Figure 16B:
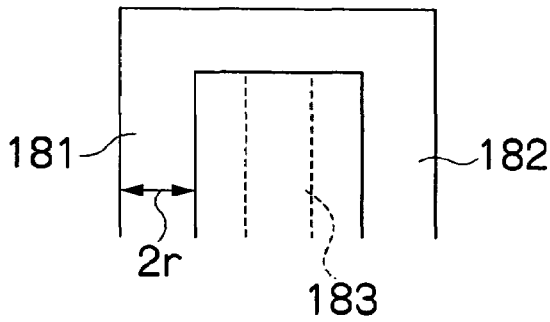

FIG. 16A is a plan view showing an example of the shape of the pressure chamber, and FIG. 16B is a side view thereof. As shown in FIGS. 16A and 16B, the pressure chamber 70 has a shape in the plane parallel to the nozzle alignment plane (nozzle face) that is substantially triangular, and the inflow and outflow channels 181, 182 and 183 of the pressure chamber are provided to the vertices of the triangular shape. The inflow and outflow channels 181, 182 and 183 in FIGS. 16A and 16B correspond to any of the nozzle flow channel 81, the separate supply channel 85 and the separate circulation channel 86 described in FIGS. 4 to 8. The vertices of the triangular shape are chamfered in an arcuate form, as shown FIG. 16A. The chamfer radius R preferably satisfies the following Formula 2 as a relationship with the radii r of the inflow and outflow channels 181 to 183:

$$r/2 \leqq R \leqq 2\times r. \quad (2)$$

A preferable aspect in one which the arrangement of flow channel ports of the three inflow and outflow channels 181, 182 and 183 in communication with the pressure chamber 70 has a symmetrical positional relationship. More specifically, a preferably aspect in one in which, when the pressure chamber is rotated 120×n degrees (where n is an integer) about the median point of the pressure chamber 70 in the plane parallel to the nozzle face, there is a match between the shapes (the symmetrical structure with respect to a rotation of 120°) of the original pressure chamber 70 and the rotated pressure chamber 70.

Also preferable is a configuration in which the nozzle flow channel port (the communication port to which the nozzle flow channel 81 is connected) and circulation flow channel port (the communication port to which the separate circulation channel 86 is connected) are arranged in symmetrical positions with respect to the supply flow channel port (the communication port to which the separate supply channel 85 is connected) in the pressure chamber 70. In accordance with this aspect, the flow is the same during discharge and during circulation, and there is no point at which pooling tends to occur in either one of the flows.

In the example shown in FIG. 16A, the area in the vicinity the substantially triangular shape is an externally facing convex curve, but the planar shape of the pressure chamber is not limited to this example.

Figure 17A:
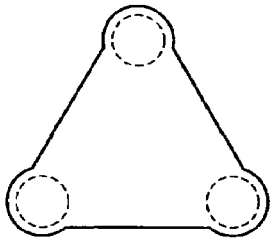
FIGS. 17A and 17B are plan views showing other examples of the shape of the pressure chamber.
Figure 17B:
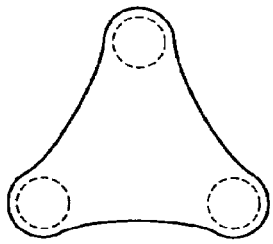

Also possible, for example, is an aspect in which the area in the vicinity of the substantially triangular shape is configured with a straight line, as shown in FIG. 17A; and also possible is an aspect in which the area in the vicinity of the substantially triangular shape is configured with a curved line in which the curvature extends inward, as shown in FIG. 17B.

Figure 18A:
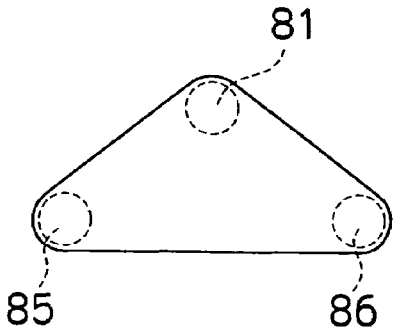
FIGS. 18A and 18B are plan views showing other examples of the shape of the pressure chamber.
Figure 18B:
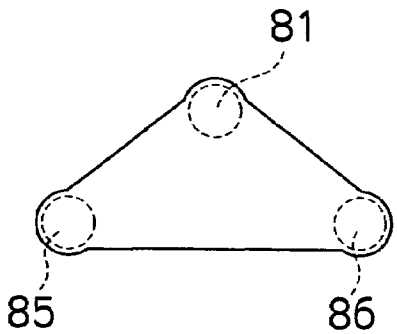

In the examples shown in FIGS. 18A and 18B, the planar shape of the pressure chambers is substantially an isosceles triangular shape, and the vertices have angles that are greater than 60°. In this case, the nozzle flow channel 81 is disposed in the apex position, and the separate supply channel 85 and the separate circulation channel 86 are respectively disposed in the lower angle positions. The feature in which the apex position of the substantially isosceles triangular shape is chamfered in an arcuate form is the same as the example in FIGS. 16A and 16B.

Figure 19:
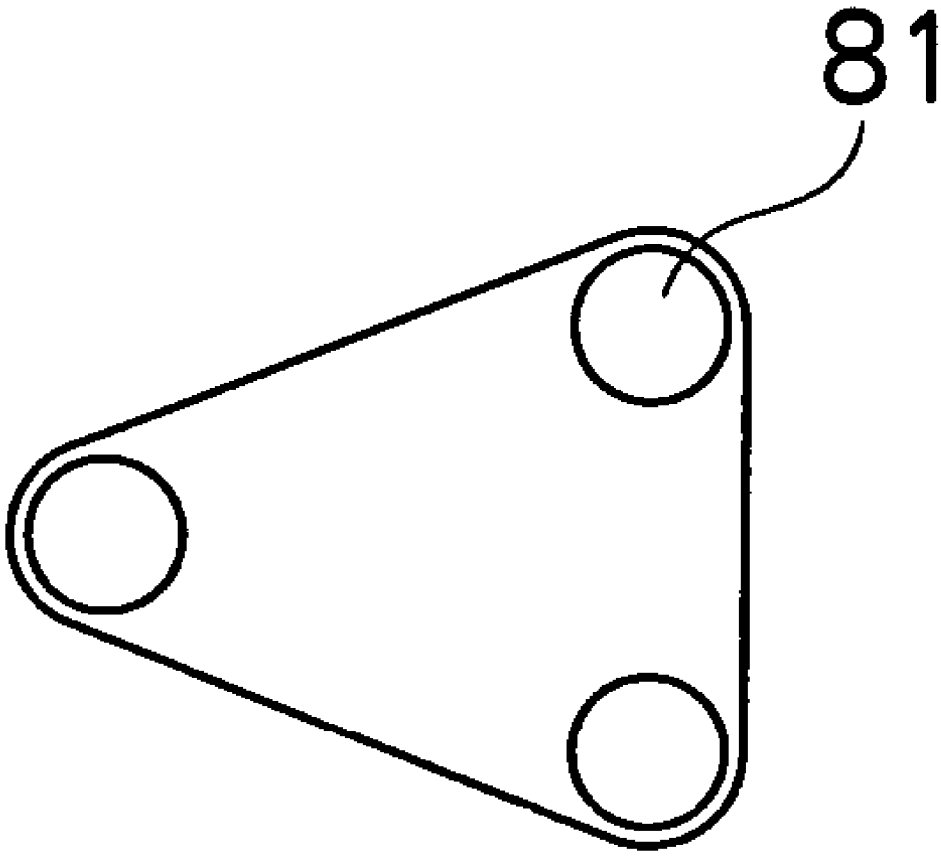
FIG. 19 is a plan view showing another example of the shape of the pressure chamber.

In the example shown in FIG. 19, the planar shape of the pressure chamber is substantially an isosceles triangular shape, and the vertices have angles that are less than 60°. In this shape, the nozzle flow channel 81 is disposed in a lower angle position. The feature in which the apex position of the substantially isosceles triangular shape is chamfered in an arcuate form is the same as the example in FIG. 16A.

In the above description, a so-called piezo-type inkjet recording apparatus was exemplified, but the applicable scope of the present invention is not limited to inkjet recording apparatuses, and the liquid discharge head of the present invention may also be adapted to various types of liquid discharge apparatuses, such as an application apparatus that applies treatment liquids and other liquids to a medium.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A droplet discharge head, comprising:

a nozzle which discharges droplets of a liquid;

a pressure chamber which is in communication with the nozzle and is filled with the liquid to be discharged from the nozzle; and a pressure generation device which generates pressure variation in the liquid inside the pressure chamber and causes the droplets to be discharged from the nozzle, wherein:

the pressure chamber has a substantially triangular planar shape;

the pressure chamber is provided with a first conduit which conducts the liquid from the pressure chamber to the nozzle, a second conduit which causes the liquid to flow into the pressure chamber, a third conduit which drains the liquid in the pressure chamber to exterior of the pressure chamber, and a switching device which opens and closes a flow channel in at least one of the second and third conduits; and the first, second and third conduits are connected to the pressure chamber at positions in vicinity of different vertices of the substantially triangular shape, respectively.

2. The droplet discharge head as defined in claim 1, wherein the switching device is disposed in the third conduit.

3. The droplet discharge head as defined in claim 1, comprising:

a plurality of the pressure chambers;

a common flow channel which is in communication with the second conduit of each of the pressure chambers; and a circulation flow channel which is in communication with the third conduit of each of the pressure chambers.

4. The droplet discharge head as defined in claim 3, further comprising a switching control device which simultaneously controlling a plurality of the switching devices disposed correspondingly to the plurality of the pressure chambers.

5. The droplet discharge head as define in claim 1, further comprising:

a supply channel side pressure adjustment device which increases pressure in the second conduit, wherein the pressure increased by the supply channel side pressure adjustment device causes the liquid to flow from the second conduit to the pressure chamber and from the pressure chamber to the third conduit.

6. The droplet discharge head as defined in claim 5, wherein the pressure is adjusted to satisfy Pa>Ps>Pc, where Ps is the pressure in the second conduit, Pc is the pressure in the third conduit, and Pa is an atmospheric pressure.

7. The droplet discharge head as define in claim 1, further comprising:

a circulation channel side pressure adjustment device which decreases pressure in the third conduit, wherein the pressure decreased by the circulation channel side pressure adjustment device causes the liquid to flow from the second conduit to the pressure chamber and from the pressure chamber to the third conduit.

8. The droplet discharge head as defined in claim 7, wherein the pressure is adjusted to satisfy Pa>Ps>Pc, where Ps is the pressure in the second conduit, Pc is the pressure in the third conduit, and Pa is an atmospheric pressure.

9. The droplet discharge head as define in claim 1, further comprising:

a supply channel side pressure adjustment device which increases pressure in the second conduit; and a circulation channel side pressure adjustment device which decreases pressure in the third conduit, wherein the pressure increased by the supply channel side pressure adjustment device and the pressure decreased by the circulation channel side pressure adjustment device cause the liquid to flow from the second conduit to the pressure chamber and from the pressure chamber to the third conduit.

10. The droplet discharge head as defined in claim 9, wherein the pressure is adjusted to satisfy Pa>Ps>Pc, where Ps is the pressure in the second conduit, Pc is the pressure in the third conduit, and Pa is an atmospheric pressure.

11. An inkjet recording apparatus, comprising:

an inkjet recording head including the droplet discharge head as defined in claim 1, wherein an image is recorded onto a recording medium by discharging ink droplets from the nozzles while the recording medium is relatively moved with respect to the inkjet recording head.

12. The inkjet recording apparatus as defined in claim 11, further comprising a circulation control device which controls the switching device, wherein:

when an image is being recorded, the circulation control device controls the switching device to close, and when no image is being recorded, the circulation control device controls the switching device to open so as to flow the liquid inside the pressure chamber into the third conduit.

* * * * *